US008479525B2

(12) United States Patent
Brand

(10) Patent No.: US 8,479,525 B2
(45) **Date of Patent: *Jul. 9, 2013**

(54) COOLER BOX WITH HANDLE ROUND

(75) Inventor: Kirsten L. Brand, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 191 days.

This patent is subject to a terminal disclaimer.

(21) Appl. No.: 13/048,917

(22) Filed: Mar. 16, 2011

(65) Prior Publication Data

US 2011/0162408 A1 Jul. 7, 2011

Related U.S. Application Data

(63) Continuation of application No. 12/496,679, filed on Jul. 2, 2009, now Pat. No. 7,926,295, which is a continuation of application No. PCT/US2008/050367, filed on Jan. 7, 2008.

(60) Provisional application No. 60/878,830, filed on Jan. 5, 2007.

(51) Int. Cl.
*B65B 63/08* (2006.01)

(52) U.S. Cl.
USPC ..... 62/60; 62/457.1

(58) Field of Classification Search
USPC ..... 62/60, 62, 457.1, 457.2, 457.3; 220/515, 220/574.2, 592.03; 229/117.16, 200, 240, 229/242; 53/48.8, 492; 206/170, 175, 427
See application file for complete search history.

(56) References Cited

U.S. PATENT DOCUMENTS

| | | | |
|---|---|---|---|
| 2,810,506 | A | 10/1957 | Kessler |
| 2,868,433 | A | 1/1959 | Anderson, Jr. |
| 2,929,060 | A | 12/1959 | Daniels |
| 2,955,739 | A | 10/1960 | Collura |
| 3,112,856 | A | 12/1963 | MacIntosh et al. |
| 3,346,399 | A | 10/1967 | Watson et al. |
| 3,355,089 | A | 11/1967 | Champlin |

(Continued)

FOREIGN PATENT DOCUMENTS

| | | |
|---|---|---|
| DE | 20 2004 018 649 U1 | 4/2005 |
| EP | 0412226 | 2/1991 |

(Continued)

OTHER PUBLICATIONS

International Search report and Written Opinion for International Application No. PCT/2009/043249.

(Continued)

*Primary Examiner* — Mohammad M Ali
(74) *Attorney, Agent, or Firm* — Womble Carlyle Sandridge & Rice, LLP

(57) ABSTRACT

A blank, carton, package, and method for enclosing a plurality of containers in a carton is disclosed. The carton includes first and second top panels, first and second side panels, and a bottom panel. The top panels each include separation lines with one top panel disposed over the other top panel when formed as a carton. The carton is openable along the separation lines to expose the containers. The carton is capable of receiving a cooling substance therewithin when the top panels are separated along the separation lines. The carton including at least two handle tear lines with a handle disposed therebetween. The handle capable of being engaged to move the carton or package as desired.

20 Claims, 19 Drawing Sheets

U.S. PATENT DOCUMENTS

| | | | | |
|---|---|---|---|---|
| 3,886,901 | A | | 6/1975 | Zeitter |
| 4,036,423 | A | | 7/1977 | Gordon |
| 4,328,923 | A | | 5/1982 | Graser |
| 4,331,289 | A | * | 5/1982 | Killy ..... 229/117.13 |
| 4,378,905 | A | | 4/1983 | Roccaforte |
| 4,498,581 | A | * | 2/1985 | Dutcher ..... 206/427 |
| 4,498,619 | A | | 2/1985 | Roccaforte |
| 4,546,914 | A | | 10/1985 | Roccaforte |
| 4,577,799 | A | | 3/1986 | Oliff |
| 4,588,084 | A | | 5/1986 | Holley, Jr. |
| 4,703,855 | A | * | 11/1987 | Moe et al. ..... 206/427 |
| 5,007,541 | A | | 4/1991 | Gunn et al. |
| 5,020,337 | A | | 6/1991 | Krieg |
| 5,161,734 | A | | 11/1992 | Ruehl et al. |
| 5,249,681 | A | * | 10/1993 | Miller ..... 206/427 |
| 5,292,058 | A | | 3/1994 | Zoss et al. |
| 5,303,863 | A | | 4/1994 | Arasim |
| 5,320,277 | A | | 6/1994 | Stout et al. |
| 5,379,944 | A | | 1/1995 | Stout et al. |
| 5,385,234 | A | | 1/1995 | Stout et al. |
| 5,472,090 | A | | 12/1995 | Sutherland |
| 5,472,136 | A | | 12/1995 | Roccaforte |
| 5,495,727 | A | | 3/1996 | Strong et al. |
| 5,505,372 | A | | 4/1996 | Edson et al. |
| 5,551,566 | A | | 9/1996 | Sutherland |
| 5,582,343 | A | | 12/1996 | Dalvey |
| 5,595,292 | A | | 1/1997 | Bates |
| 5,639,017 | A | | 6/1997 | Fogle |
| 5,794,778 | A | | 8/1998 | Harris |
| 5,826,782 | A | * | 10/1998 | Stout ..... 229/117.13 |
| 5,873,515 | A | * | 2/1999 | Dunn et al. ..... 229/117.13 |
| 5,915,546 | A | | 6/1999 | Harrelson |
| 5,992,733 | A | | 11/1999 | Gomes |
| 6,021,897 | A | | 2/2000 | Sutherland |
| 6,065,590 | A | | 5/2000 | Spivey |
| 6,112,977 | A | | 9/2000 | Sutherland et al. |
| 6,164,526 | A | | 12/2000 | Dalvey |
| 6,176,419 | B1 | * | 1/2001 | Holley, Jr. ..... 229/122.1 |
| 6,260,755 | B1 | | 7/2001 | Bates et al. |
| 6,273,330 | B1 | * | 8/2001 | Oliff et al. ..... 229/117.13 |
| 6,302,320 | B1 | | 10/2001 | Stout |
| 6,536,656 | B2 | * | 3/2003 | Auclair et al. ..... 229/117.13 |
| 6,554,159 | B1 | * | 4/2003 | Behr et al. ..... 221/305 |
| 6,676,013 | B2 | * | 1/2004 | Auclair ..... 229/122 |
| D490,703 | S | | 6/2004 | Rusnock |
| 6,834,793 | B2 | | 12/2004 | Sutherland |
| 6,869,009 | B2 | | 3/2005 | Sutherland et al. |
| 6,926,193 | B2 | | 8/2005 | Smalley |
| 6,945,450 | B2 | | 9/2005 | Rusnock |
| 7,234,596 | B2 | | 6/2007 | Lebras |
| 7,374,043 | B2 | * | 5/2008 | Holley et al. ..... 206/427 |
| 7,380,701 | B2 | | 6/2008 | Fogle et al. |
| 7,416,109 | B2 | | 8/2008 | Sutherland |
| 7,467,713 | B2 | | 12/2008 | Harrelson |
| 7,601,111 | B2 | | 10/2009 | Sutherland et al. |
| 7,611,042 | B2 | | 11/2009 | Bates et al. |
| 7,717,318 | B2 | | 5/2010 | Brand |
| 7,727,318 | B2 | | 6/2010 | Feng et al. |
| 7,743,944 | B2 | | 6/2010 | Ho Fung et al. |
| 7,926,295 | B2 | | 4/2011 | Brand |
| 2005/0167476 | A1 | | 8/2005 | Ikeda |
| 2006/0032899 | A1 | | 2/2006 | Bell |
| 2006/0081690 | A1 | | 4/2006 | Bates et al. |
| 2006/0273143 | A1 | | 12/2006 | Finch |
| 2007/0051781 | A1 | | 3/2007 | Holley, Jr. |
| 2007/0164091 | A1 | | 7/2007 | Fogle et al. |
| 2007/0181658 | A1 | | 8/2007 | Sutherland |
| 2007/0284424 | A1 | | 12/2007 | Holley |
| 2008/0083820 | A1 | | 4/2008 | Walling et al. |
| 2008/0099544 | A1 | | 5/2008 | Skolik |
| 2008/0119344 | A1 | | 5/2008 | Sutherland et al. |
| 2009/0255983 | A1 | | 10/2009 | De Paula et al. |

FOREIGN PATENT DOCUMENTS

| | | | |
|---|---|---|---|
| EP | 2121456 | | 4/2011 |
| FR | 1494239 | | 9/1967 |
| FR | 2579175 | | 9/1986 |
| JP | 2000177727 | | 6/2000 |
| JP | 2004292023 | | 10/2004 |
| WO | WO-2006/119360 | A1 | 11/2006 |
| WO | WO2007089282 | | 8/2007 |

OTHER PUBLICATIONS

Office Action dated Jul. 14, 2010 from parent U.S. Appl. No. 12/496,679.

Amendment and Response to Office Action dated Nov. 5, 2010 from parent U.S. Appl. No. 12/496,679.

Second Amendment and Response to Office Action dated Dec. 7, 2010 from parent U.S. Appl. No. 12/496,679.

Notice of Allowance and Examiner's Amendment dated Dec. 14, 2010 from parent U.S. Appl. No. 12/496,679.

Search Report and Written Opinion dated Mar. 28, 2008 from PCT/US2008/050367.

Examination Report dated Feb. 3, 2010 from EP Application No. 08 705 738.6-2308.

Office Action dated Nov. 8, 2010 from CN Application No. 200880004699.1 (including translation).

Second Office Action dated Feb. 23, 2011 from CN Application No. 200880004699.1 (including foreign associate's letter as partial translation).

* cited by examiner

COOLER BOX WITH HANDLE ROUND

CROSS-REFERENCE TO RELATED APPLICATIONS

This application is a continuation of U.S. patent application Ser. No. 12/496,679, filed Jul. 2, 2009, now U.S. Pat. No. 7,926,295 which is a continuation of International Application No. PCT/US2008/050367, filed Jan. 7, 2008, entitled "Cooler Box With Handle Round," which designates the United States of America and which claims the benefit under 35 U.S.C. §119(e) of U.S. Provisional Application No. 60/878,830, filed Jan. 5, 2007.

BACKGROUND OF THE INVENTION

Cartons with various handle, opening, and reinforcement features are known in the art. Further, cartons that are capable of enclosing and dispensing articles are known. Although cartons that are capable of enclosing, dispensing, and chilling articles are not known in the art, there is always a desire for a new balance of properties.

SUMMARY OF THE INVENTION

The entire disclosures of U.S. patent application Ser. No. 12/496,679, International Application No. PCT/US2008/050367 and U.S. Provisional Application No. 60/878,830 are hereby incorporated by reference in their entirety as though fully set forth herein.

A blank, carton, package, and method for enclosing a plurality of containers in a carton is disclosed. The carton of an embodiment of the present invention includes first and second top panels, first and second side panels, and a bottom panel. The top panels each include separation lines with one top panel disposed over the other top panel when formed as a carton. The carton is openable along the separation lines to expose the containers. The carton is capable of receiving a cooling substance therewithin when the top panels are separated along the separation lines.

One aspect of the invention includes a method of cooling containers in a carton that includes a first top panel, a second top panel, two side panels, and a bottom panel. The first top panel is separable along a first separation line and the second top panel is separable along a second separation line. The method includes separating the first top panel into two first sections along the first separation line, separating the second top panel into two second sections along the second separation line to expose the containers in the carton, and supplying a cooling substance, such as ice for example, into the carton proximate the containers. When formed into a carton, generally, the first separation line and the second separation line are parallel with the first separation line lying over the second separation line. The first separation line includes a first access opening therealong and the second separation line includes a second access opening therealong. Alternatively, the first access opening or the second access opening can be covered by a finger flap. When formed as a carton, generally the first access opening is disposed above and adjacent and the second access opening to form a common access opening. Further, the method can include removing at least one of the containers from the carton. Further still, the method can include separating at least one end separation line on both ends of the carton with the more than one layers of paperboard enlarging the opening when the first and second separation lines are separated.

Another aspect of the invention includes a blank capable of being formed in a carton. The blank includes a first top panel with a first separation line capable of separating the first top panel into two first sections. The first top panel is connected to a first side panel along a first fold line, the first side panel is connected to a bottom panel along a second fold line, and the bottom panel is connected to a second side panel along a third fold line. The second side panel is connected to a second top panel along a fourth fold line, the second top panel includes a second separation line capable of separating the second top panel into two second sections, and the second side panel is connected to a connecting panel along a fifth fold line. The blank also includes a first transverse fold line and a second transverse fold line disposed perpendicular the first, second, third, fourth, and fifth fold lines. The first transverse fold line and the second transverse fold line defining end flaps along edge portions of the first top panel, first side panel, bottom panel, second side panel, and second top panel. The blank can also include a first access opening along the first separation line. The blank can also include a second access opening along the second separation line. The first access opening and/or the second access opening can be covered by a first finger flap. The blank can further be defined by the two first sections being approximately half the first top panel and the two second sections being approximately half the second top panel. The blank can also include a handle disposed in the connecting panel. Further, the second top panel can include a first end flap adjacent the first transverse fold line and a second end flap adjacent the second transverse fold line, with the second separation line extending into the first end flap and the second end flap. Further still, the blank can include a third separation line in the first end flap and a fourth separation line in the second end flap, with the third separation line and the fourth separation line generally parallel the first and second transverse fold lines.

Another aspect of the invention can include a package with a plurality of containers enclosed in a carton that includes a first top panel, a second top panel, a first side panel, a second side panel, and a bottom panel. The first top panel includes a first separation line, the second top panel includes a second separation line, and the second top panel can be disposed over the first top panel when the carton encloses the containers therewithin. The carton can be opened along the first and second separation lines to expose the containers therewithin. Once opened, the carton is capable of receiving a cooling substance, such as ice for example, therewithin when the first top panel is separated along the first separation line and when the second top panel is separated along the second separation line. The package can include a first access opening along the first separation line and a second access opening along the second separation line. The first access opening and/or the second access opening can be covered by a first finger flap.

Another aspect of the invention includes a handle and a method of engaging the handle for a carton enclosing a plurality of containers. The handle being disposed between a first tear line and a second tear line, which are generally parallel. The method comprising engaging an opening adjacent the handle and separating the handle along a first tear line and a second tear line. The handle being a portion of a panel of the carton before separation.

Various other aspects, features, and advantages of the present invention will become more apparent upon reading the following specification in conjunction with the accompanying drawing figures.

BRIEF DESCRIPTION OF THE DRAWINGS

The drawings are briefly described in the following, in accordance with an embodiment of the present invention.

DETAILED DESCRIPTION

Figure 1:
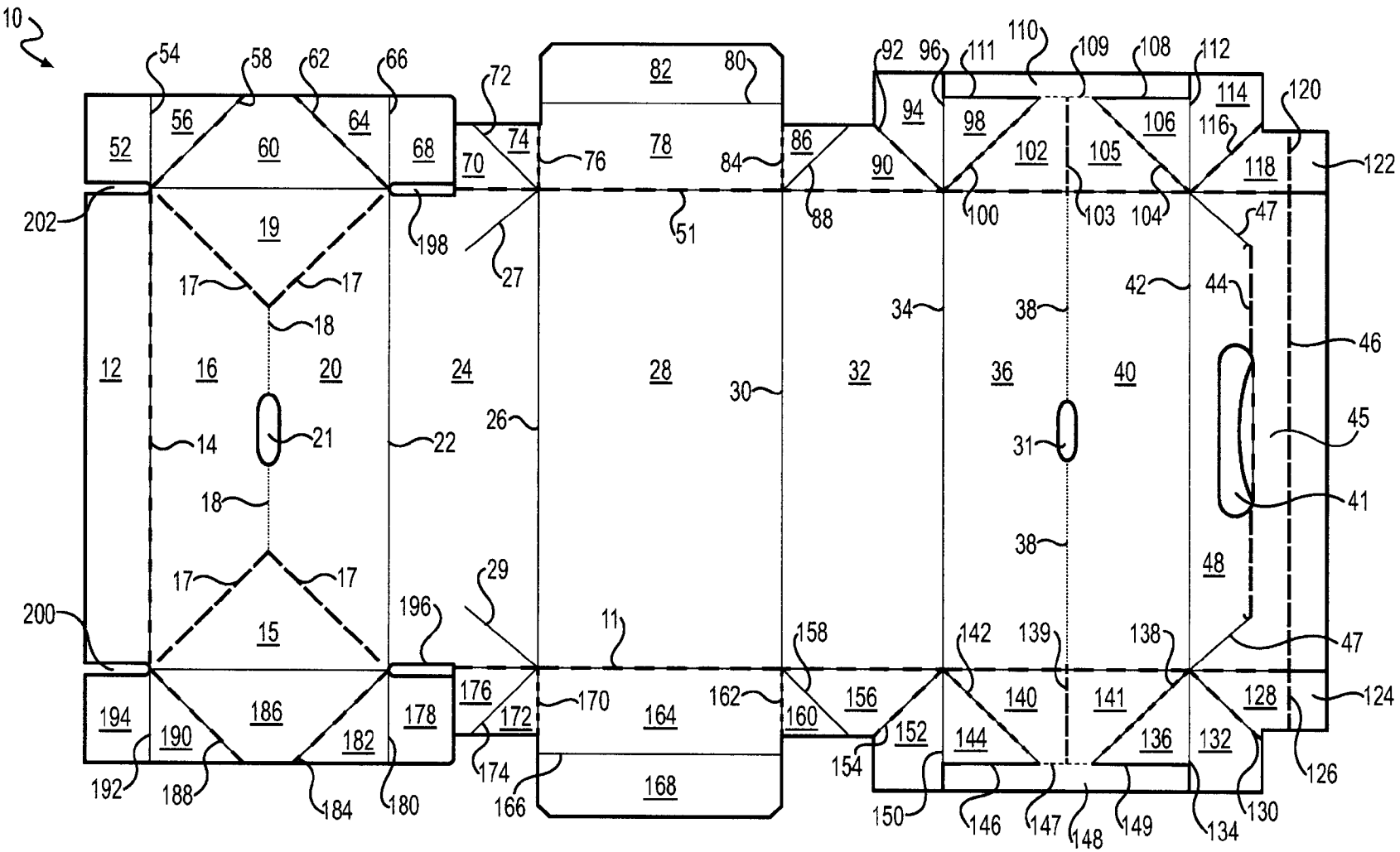
FIG. 1 shows a blank capable of being formed into a carton according to the present invention.

For a more complete understanding of an embodiment of the present invention, reference should be made to the following detailed description and accompanying drawings, wherein like reference numerals designate corresponding parts throughout the figures.

To facilitate understanding and explanation of the blank of an embodiment of the present invention, the elements and numerals described herein will utilize the terms "upper," "lower," "top," "bottom," "front," and "back" to distinguish portions of the carton and of the blank. These conventions are included merely for ease of explanation and understanding of the present description, however, and should not be limiting in any manner. The descriptions of the panels as "upper," "lower," etc., also can be referred to as "first," "second," etc.

FIG. 1 shows a blank 10 capable of being formed a carton according to an embodiment of the present invention. Blank 10 includes panel 12 connected to panel 16 along fold line 14. Panel 16 represents one side of a single panel (which can be referenced as "first top panel"), with the other side represented by panel 20. Panel 16 and panel 20 are connected to one another along separation line 18 (e.g., tear line). Panel 20 is connected to panel 24 along fold line 22 (which can be referenced as "first fold line"). Panel 24 is connected to panel 28 along fold line 26 (which can be referenced as "second fold line"). Panel 28 is connected to panel 32 along fold line 30 (which can be referenced as "third fold line"). Panel 32 is connected to panel 36 along fold line 34 (which can be referenced as "fourth fold line"). Panel 36 comprises one side of a single panel (which can be referenced as "second top panel"), with the other side represented by panel 40. Panel 36 and panel 40 are connected along separation line 38 (e.g., tear line). Panel 40 is connected to panel 48 along fold line 42. Panel 48 includes two fold lines 47, separation lines 44 and 46, handle 45, and handle aperture 41.

Fold lines 14, separation line 18, fold line 22, fold line 26, fold line 30, fold line 34, separation line 38, fold line 42, and separation lines 44 and 46 are substantially parallel to one other and, in general, run perpendicular to transverse fold lines 11 and 51 that foldably connect the panels to corresponding end flaps. Separation line 18, which separates panels 16 and 20 into generally two equal sized portions, has an opening feature 21 disposed therealong. Similarly, separation line 38 has an opening feature 31 disposed therealong. Such opening feature 21 or 31 can be an access hole or finger flap covering an access hole that allows entry of a finger or other object to begin separation along separation line 18 or 38 when desired, such as by an end user. For example, as shown in FIG. 1, opening feature or finger flap 21 can be referenced as a "first finger flap" and opening feature or finger flap 31 can be referenced as a "second finger flap". Also included between panels 16 and 20 and corresponding end flaps 60 and 186 are tear lines 17 which are shown to extend generally in a triangular manner away from separation line 18 toward intersection points at the intersection between fold lines 14 and 22 and fold lines 11 and 51. Accordingly, generally triangular shaped portions 15 and 19 are formed by tear lines 17 and fold lines 11 and 51, respectively. These triangular shaped panels, 15 and 19, are useful to form the open carton into a shape for receiving ice or other addition therein.

The blank 10 includes two cutouts or apertures 198 and 202 which are generally parallel and co-extensive with fold line 51 to separate certain end flaps from respective panels. Cutout 202 separates end flap 52 from panel 12. End flap 52 is foldably connected to panel 56 along fold line 54, which is generally parallel and co-extensive with fold line 14. End flap 56 is connected to end flap 60 along fold line 58. End flap 60 is connected to end flap 64 along fold line 62. Fold lines 58 and 62 are generally diagonal. End flap 64 is connected to end flap 68 along fold line 66. Fold line 66 is generally parallel and is generally co-extensive with fold line 22. Cutout 198 separates end flap 68 from panel 24.

End flap 68 and end flap 70 are shown as separate segments and are not connected generally (e.g., they are separated by a slit). End flap 70 is connected to end flap 74 along fold line 72, which is generally diagonal. End flap 70 is connected to panel 24 along fold line 51. A generally diagonal fold line 27 is included in panel 24 and is at substantially the same angular orientation of fold line 72. End flap 74 is connected to end flap 78 along fold line 76. Fold line 76 is generally parallel and is generally co-extensive with fold line 26. End flap 78 is connected to panel 28 along fold line 51. End flap 78 is a first part of one end flap and is connected to a second part of the end flap, represented at end flap 82, along fold line 80. Generally, fold line 80 is substantially parallel to fold line 51.

End flap 78 is connected to end flap 86 along fold line 84. Fold line 84 is generally parallel and is generally co-extensive with fold line 30. End flap 86 is connected to end flap 90 along fold line 88, which is generally diagonal. End flap 90 is connected to end flap 94 along fold line 92, which is generally diagonal. End flap 90 is connected to panel 32 along fold line 51. End flap 94 is connected to end flap 98 along fold line 96. Fold line 96 is generally co-extensive and parallel with fold line 34.

End flap 98 is connected to end flap 102 along fold line 100, which is generally diagonal. End flap 102 (which can be referenced as a "first end flap") is connected to end flap 105 (which can be referenced as a "second end flap") along tear line 103. Tear line 103 is generally parallel and co-extensive with separation line 38. Tear line 103 separates end flaps 102 and 105 into substantially equal halves. End flap 105 is connected to end flap 106 along fold line 104, which is generally diagonal. End flaps 98 and 106 are connected to end flap panel 110 along separation lines 111 and 108, respectively. End flaps 102 and 105 are connected to end flap 110 along separation line 109 (e.g., tear line). Generally, separation lines 108 and 111 and separation line 109 are generally parallel and co-extensive with one another. Separation lines 108 and 111 can be slits or fold lines.

End flap 106 and end flap 110 are connected to end flap 114 along fold line 112. Fold line 112 is generally parallel and co-extensive with fold line 42. End flap 114 is connected to end flap 118 along fold line 116, which is generally diagonal. End flap 118 is connected to end flap 122 along separation line 120 (e.g., tear line). Separation line 120 is generally parallel and co-extensive with separation line 46. End flaps 118 and 122 are connected to panel 48 along fold line 51. Further, lengths of fold lines 96 and 112 can be segmented between fold lines and slits, with slits extending along sections of fold lines 96 and 112 that are adjacent end flap 110, from lines 96 and 112 to the periphery of end flap 110.

End flaps 124 and 128 are connected to panel 48 along fold line 11. End flap 124 is connected to end flap 128 along separation line 126 (e.g., tear line). Separation line 126 is generally parallel and co-extensive with separation line 46. End flap 128 is connected to end flap 132 along fold line 130, which is generally diagonal. End flap 132 is connected to end flap 136 along fold line 134. Fold line 134 is generally parallel and co-extensive with fold line 42.

End flap 136 is connected to end flap 141 along fold line 138, which is generally diagonal. End flap 141 is connected to end flap 140 along separation line 139 (e.g., tear line). Separation line 139 is generally parallel and co-extensive with separation line 38. End flaps 140 and 141 are connected to panels 36 and 40, respectively, along fold line 11. End flap 140 is connected to end flap 144 along fold line 142, which is generally diagonal. End flap 144 and end flap 136 are connected to end flap 148 along separation line 146 and 149, respectively. End flaps 140 and 141 are connected to end flap 148 along separation line 147 (e.g., tear line). Separation lines 146 and 149 and separation line 147 are generally parallel and co-extensive with each other. Separation lines 146 and 149 can be slits or fold lines.

End flap 144 is connected to end flap 152 along fold line 150. Fold line 150 extends generally parallel and is co-extensive with fold line 34. End flap 152 is connected to end flap 156 by fold line 154, which is generally diagonal. End flap 156 is connected to panel 32 by fold line 11. End flap 156 is connected to end flap 160 along fold line 158, which is generally diagonal. End flap 160 is connected to end flap 164 along fold line 162. Fold line 162 is generally parallel and co-extensive with fold line 30. Further, lengths of fold lines 134 and 150 can be segmented between fold lines and slits, with slits extending along sections of fold lines 134 and 150 that are adjacent end flap 148, from lines 146 and 149 to the periphery of end flap 148.

End flap 164 is connected to panel 28 along fold line 11. End flap 164 is a first part of one end flap and is connected to a second part of the end flap, represented at end flap 168, along fold line 166. Generally, fold line 166 is substantially parallel to fold line 11. End flap 164 is connected to end flap 172 along fold line 170. Fold line 170 is generally parallel and co-extensive with fold line 26. End flap 172 is connected to end flap 176 by fold line 174, which is generally diagonal. A fold line 29 extends generally diagonally into panel 24 from the intersection of fold lines 11 and 26. Fold lines 27 and 29 are generally for aesthetic purposes by providing a clean stress line on the package when the package is under stress. Generally, when formed into a carton, stress extends from the handle 45 to the corners of the panel at intersections with the panel end flaps. The crease in the panel formed by fold lines 27 and 29 appears to guide stress down the stress line along the fold lines 27 and 29, which creates a clean sight line on the package.

End flap 178 and end flap 176 as shown as separate segments and are not connected generally (e.g., they are separated by a slit). End flap 178 is connected to end flap 182 along fold line 180. Fold line 180 is generally parallel and co-extensive with fold line 22. The blank 10 includes two cutouts or apertures 196 and 200 which are generally parallel and co-extensive with fold line 11 to separate certain end flaps from respective panels. End flap 178 is separated from panel 24 along cutout 196. End flap 182 is connected to end flap 186 along fold line 184, which is generally diagonal. End flap 186 is connected to triangular panel 15 along fold line 11. End flap 186 is connected to end flap 190 along fold line 188, which is generally diagonal. End flap 190 is connected to end flap 194 along fold line 192. Fold line 192 is generally parallel and co-extensive with fold line 14. End flap 194 is connected to panel 12 along cutout 200.

Figure 2:
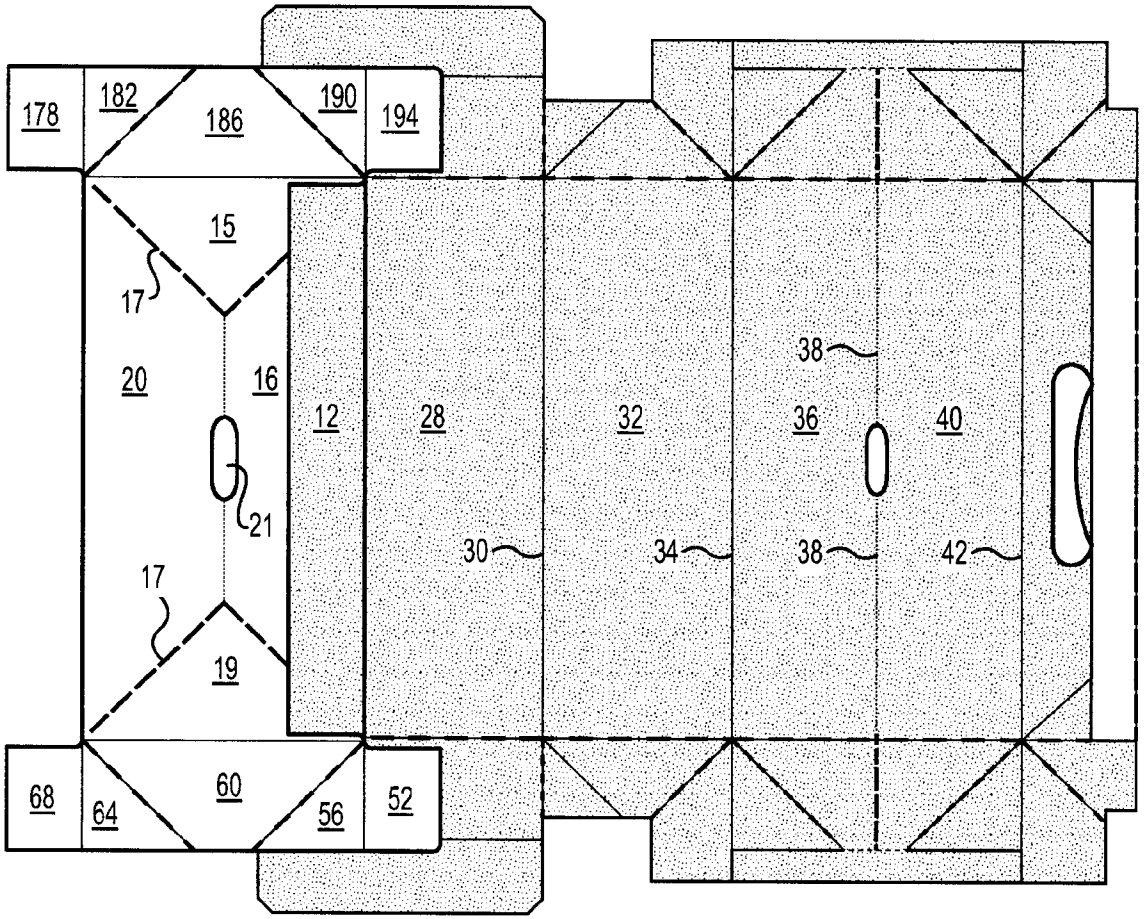
FIGS. 2-8 show the steps of folding the blank of FIG. 1 into a sleeve.
Figure 3:
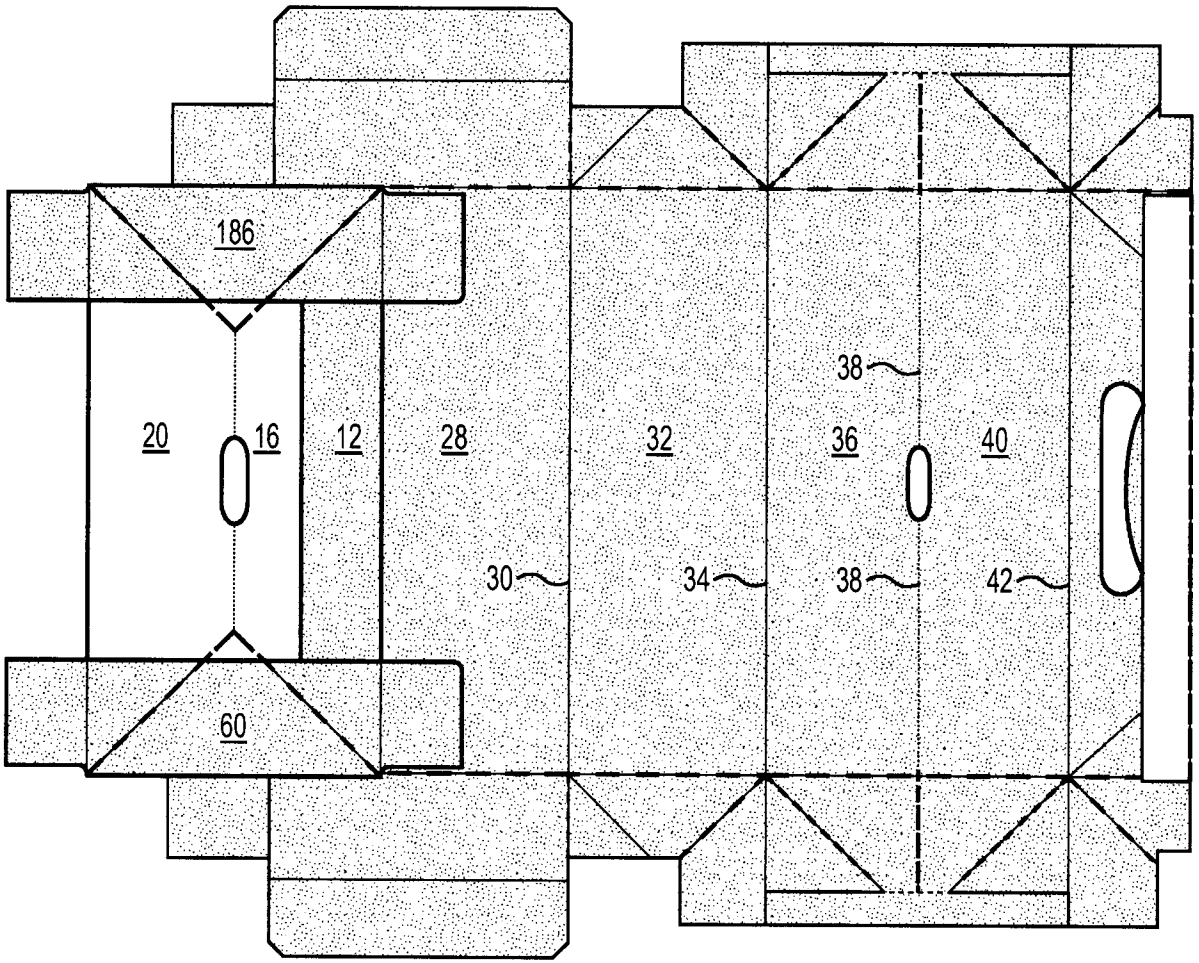

FIGS. 2-11 illustrate erection of the blank 10 in accordance with one acceptable example. FIG. 2 shows the blank 10 of FIG. 1 folded along fold line 22 to place panel 20 over panel 24. Also shown in FIG. 2, panel 12 is folded along fold line 14 to dispose panel 12 over panel 16. FIG. 3 shows end flaps 52, 56, 60, 64, and 68 folded along fold line 51 to be disposed over panels 12, 16, 19, and 20 and end flaps 178, 182, 186, 190, and 194 folded along fold line 11 to be disposed over panels 12, 15, 16, and 20. Optionally, panel 12 can be attached to adjacent panels on folding/erecting, such as to the inner surface of panel 36 with adhesive or other material.

Figure 4:
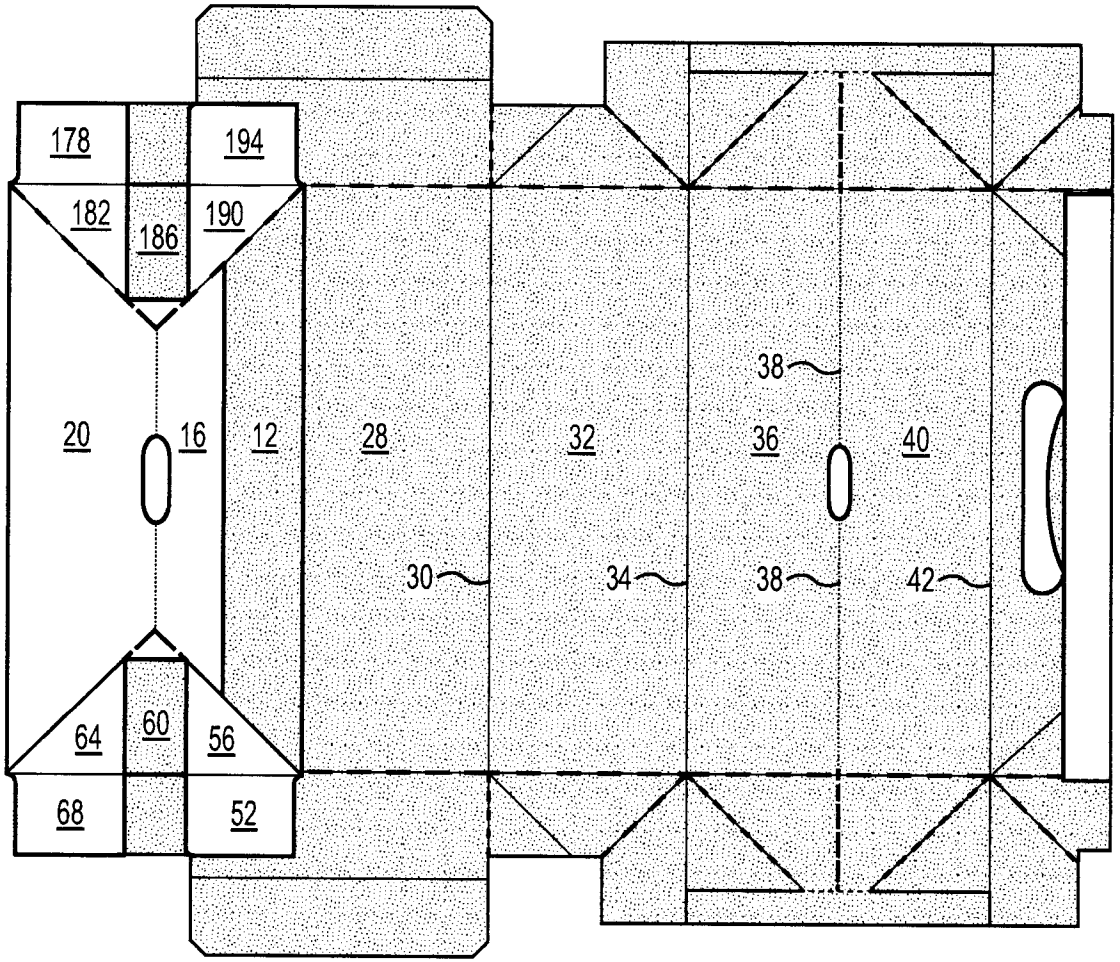

FIG. 4 shows the blank 10 with end flaps 178 and 182 folded over end flap 186 along diagonal fold line 184 and end flaps 190 and 194 folded over end flap 186 along diagonal fold line 188. FIG. 4 also shows end flaps 64 and 68 folded over end flap 60 along diagonal fold line 62 and end flaps 52 and 56 folded over end flap 60 along diagonal fold line 58.

Figure 5:
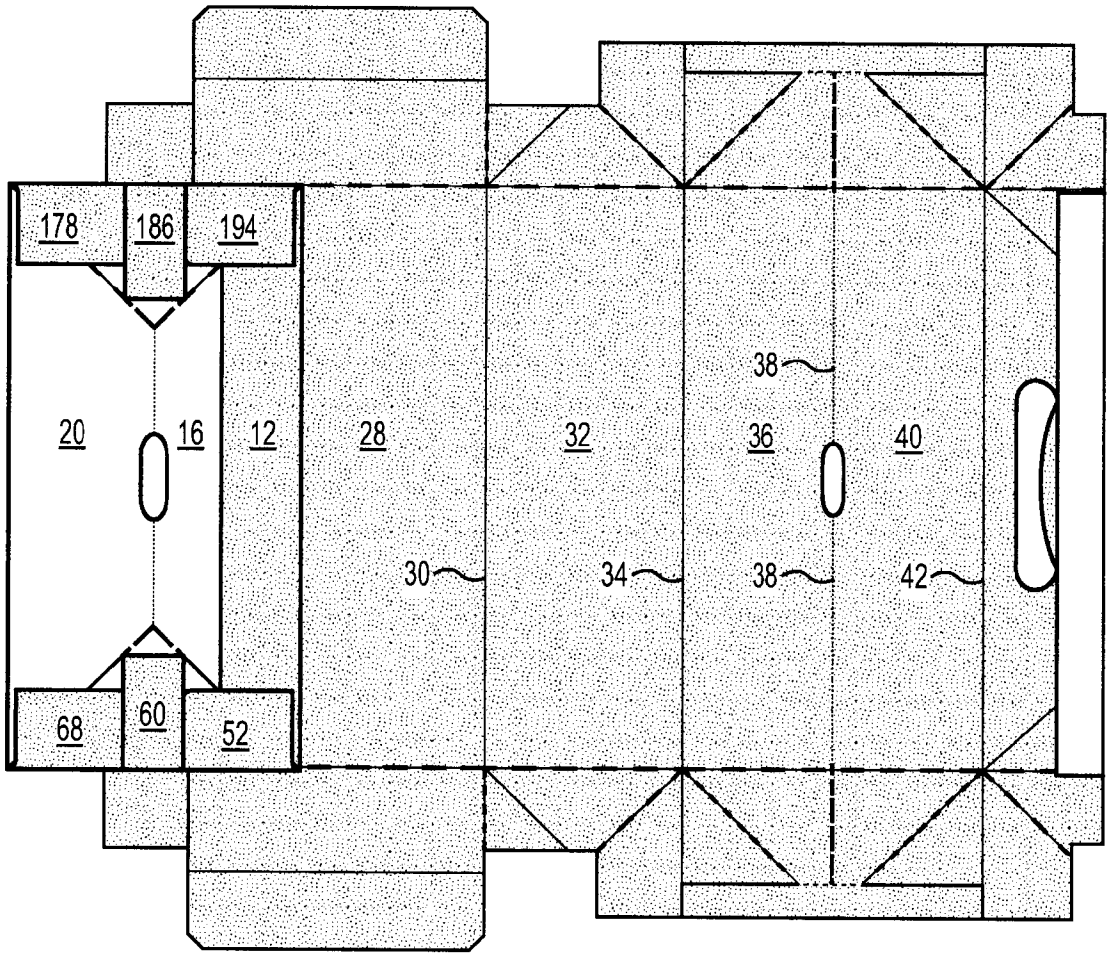

FIG. 5 shows end flap 178 folded over end flap 182 along fold line 180 and end flap 194 folded over end flap 190 along fold line 192. FIG. 5 also shows end flap 68 folded over end flap 64 along fold line 66 and end flap 52 folded over end flap 56 along fold line 54.

Figure 6:
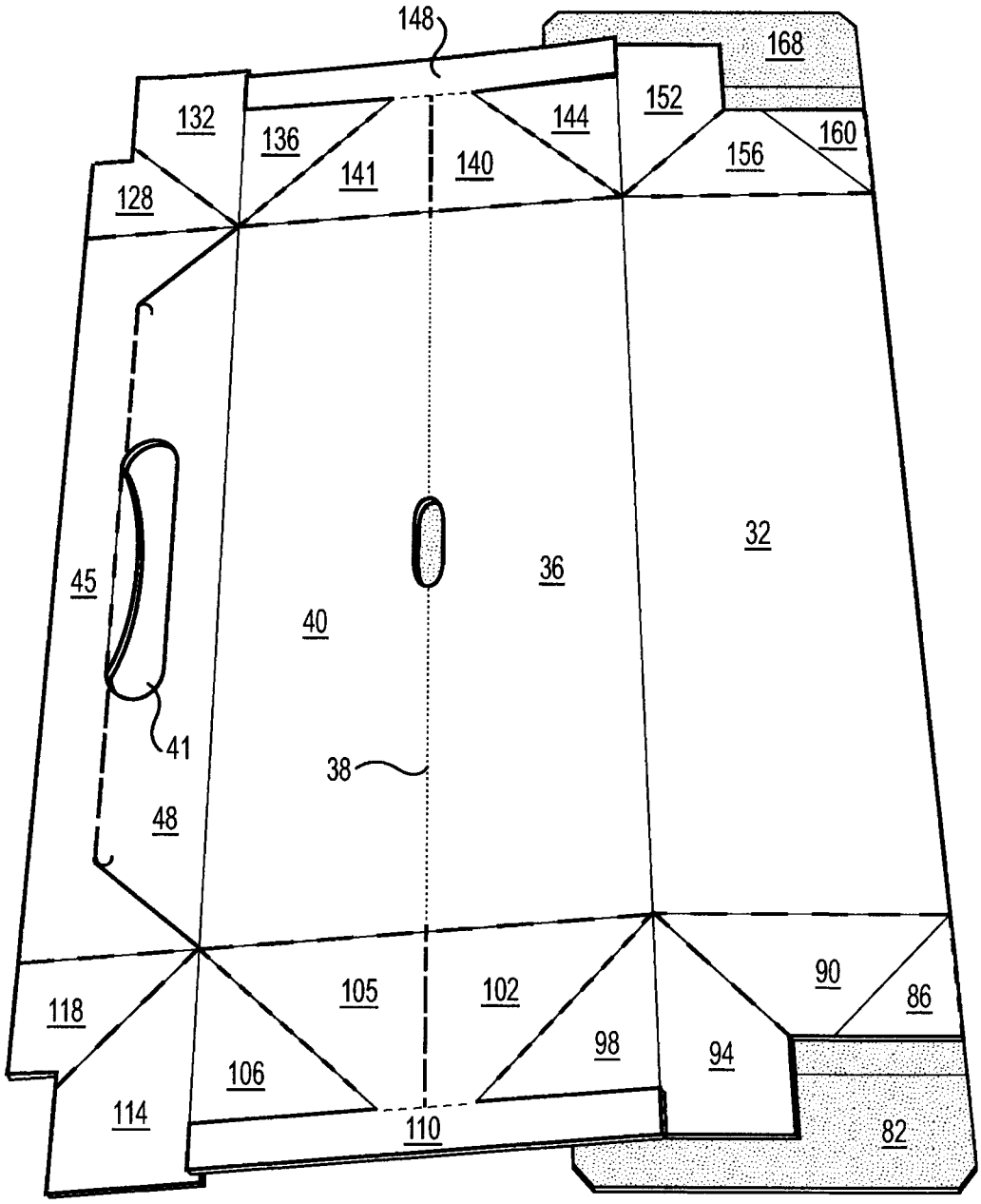
Figure 7:
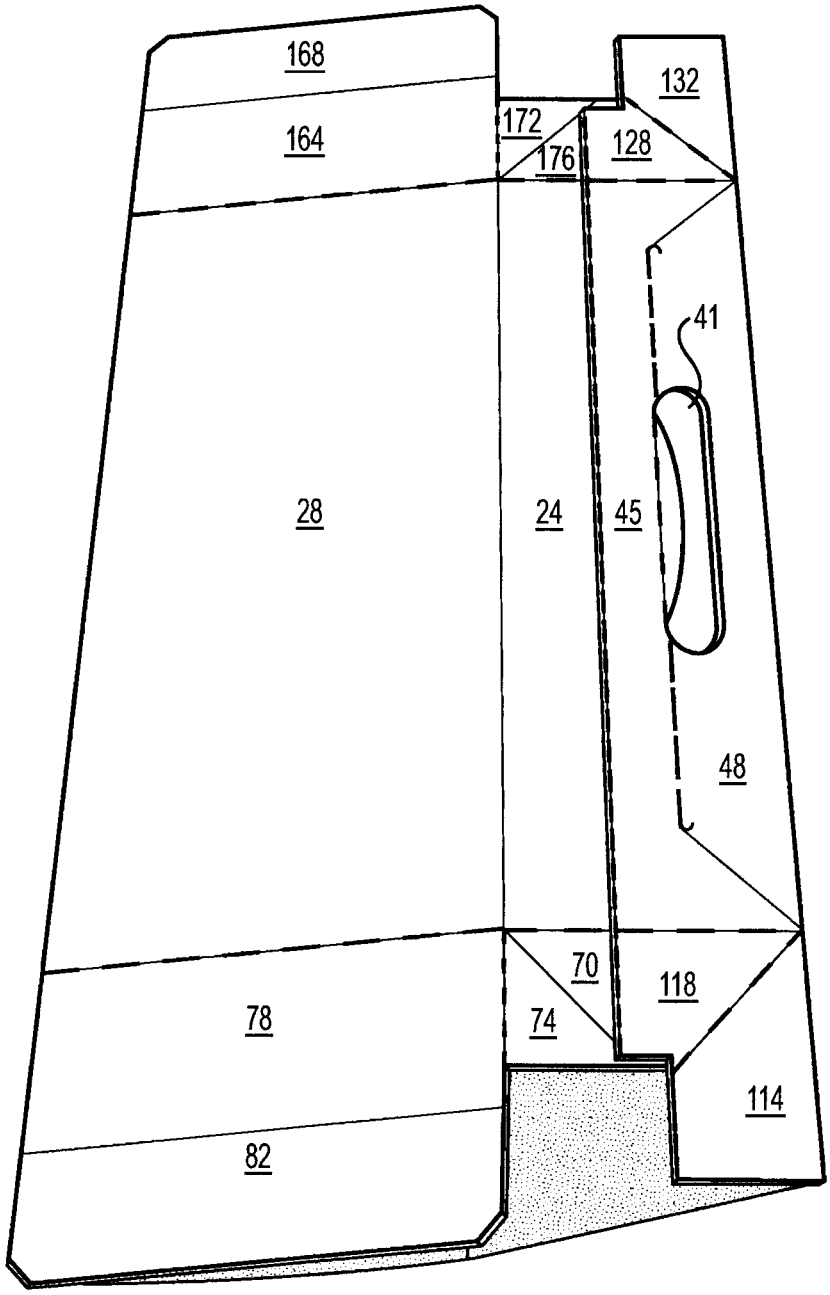
Figure 17:
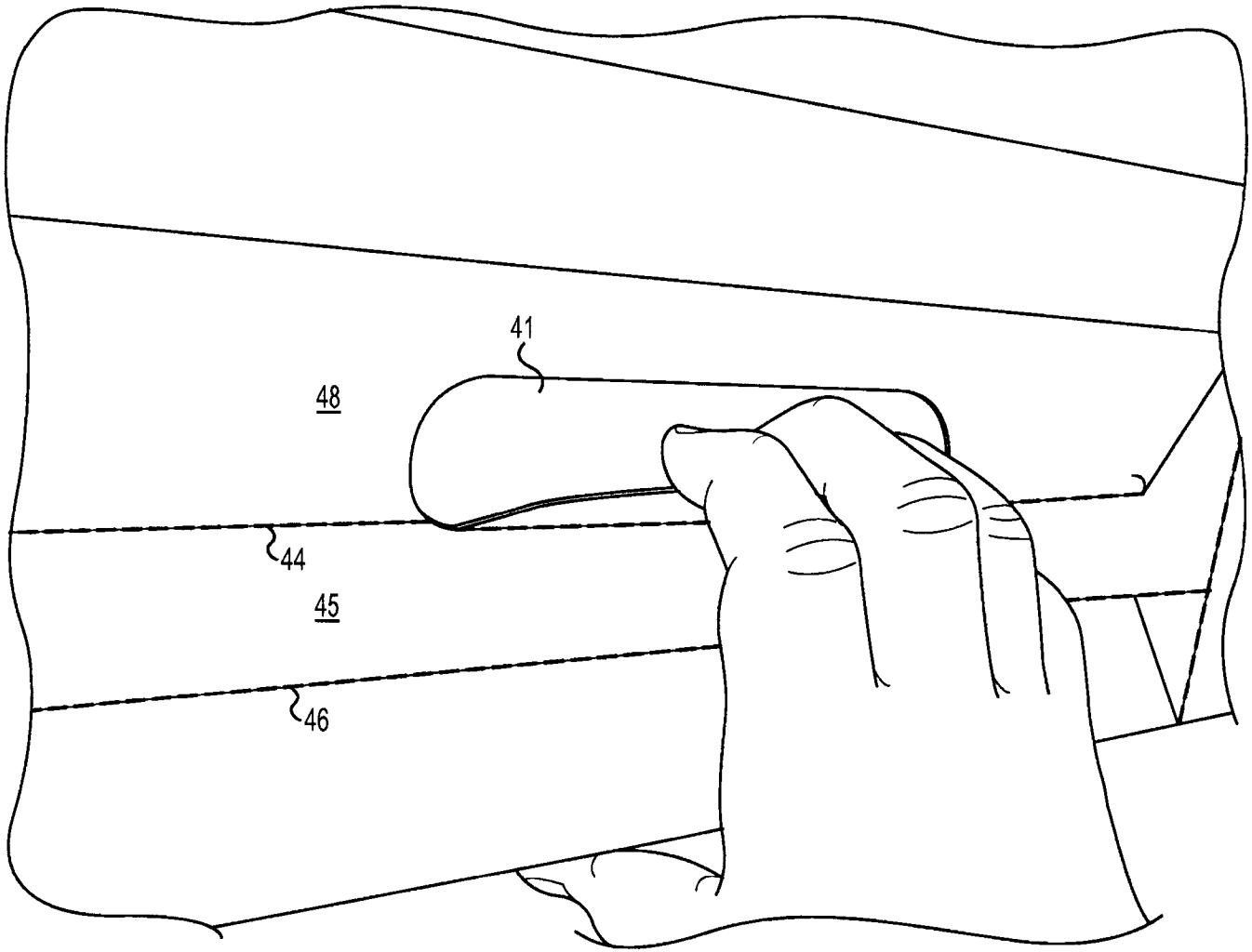
FIG. 17 shows engagement of the handle receiving opening to activate the handle.
Figure 18:
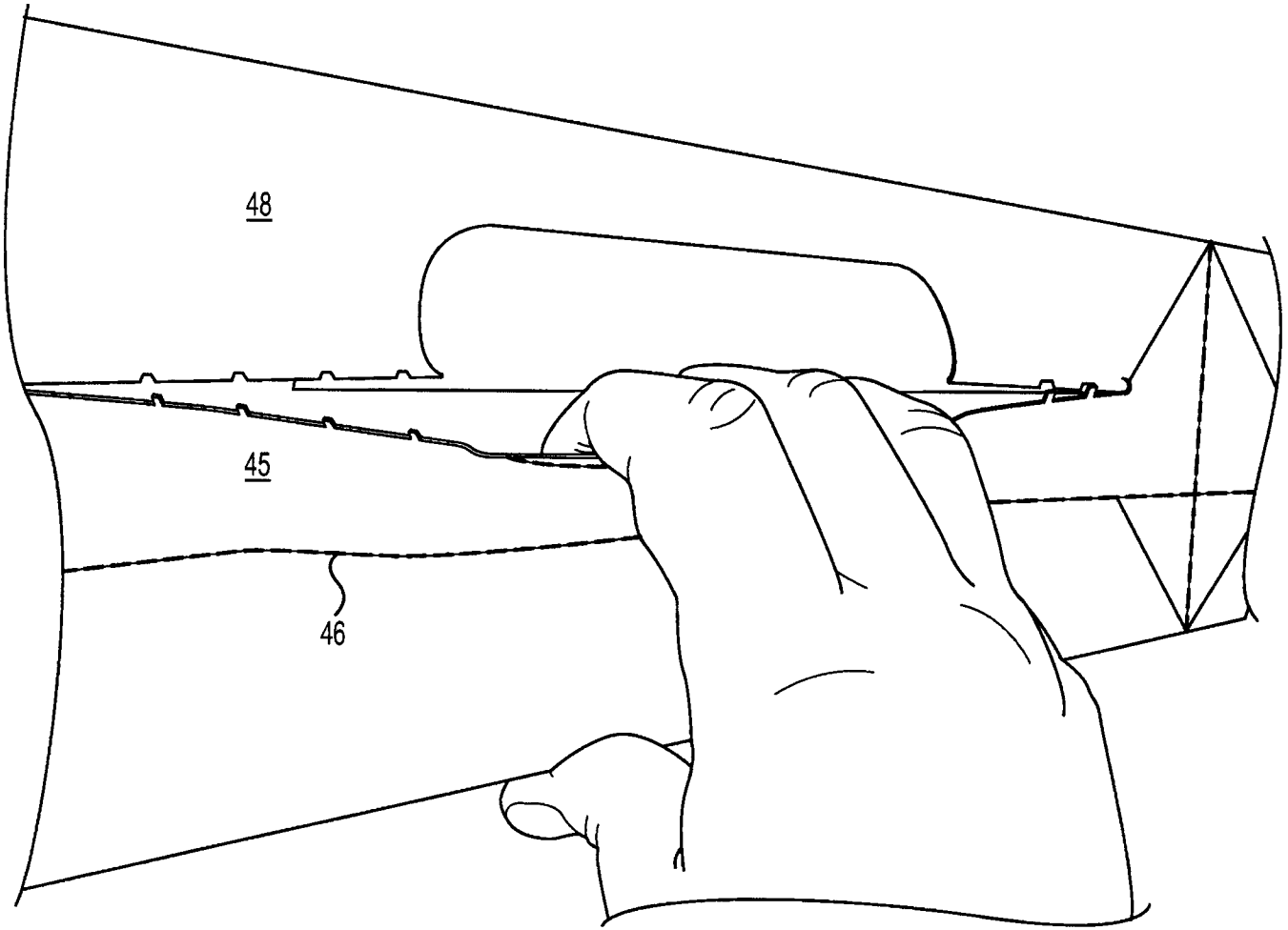
FIG. 18 shows separation along tear lines to further activate the handle.
Figure 19:
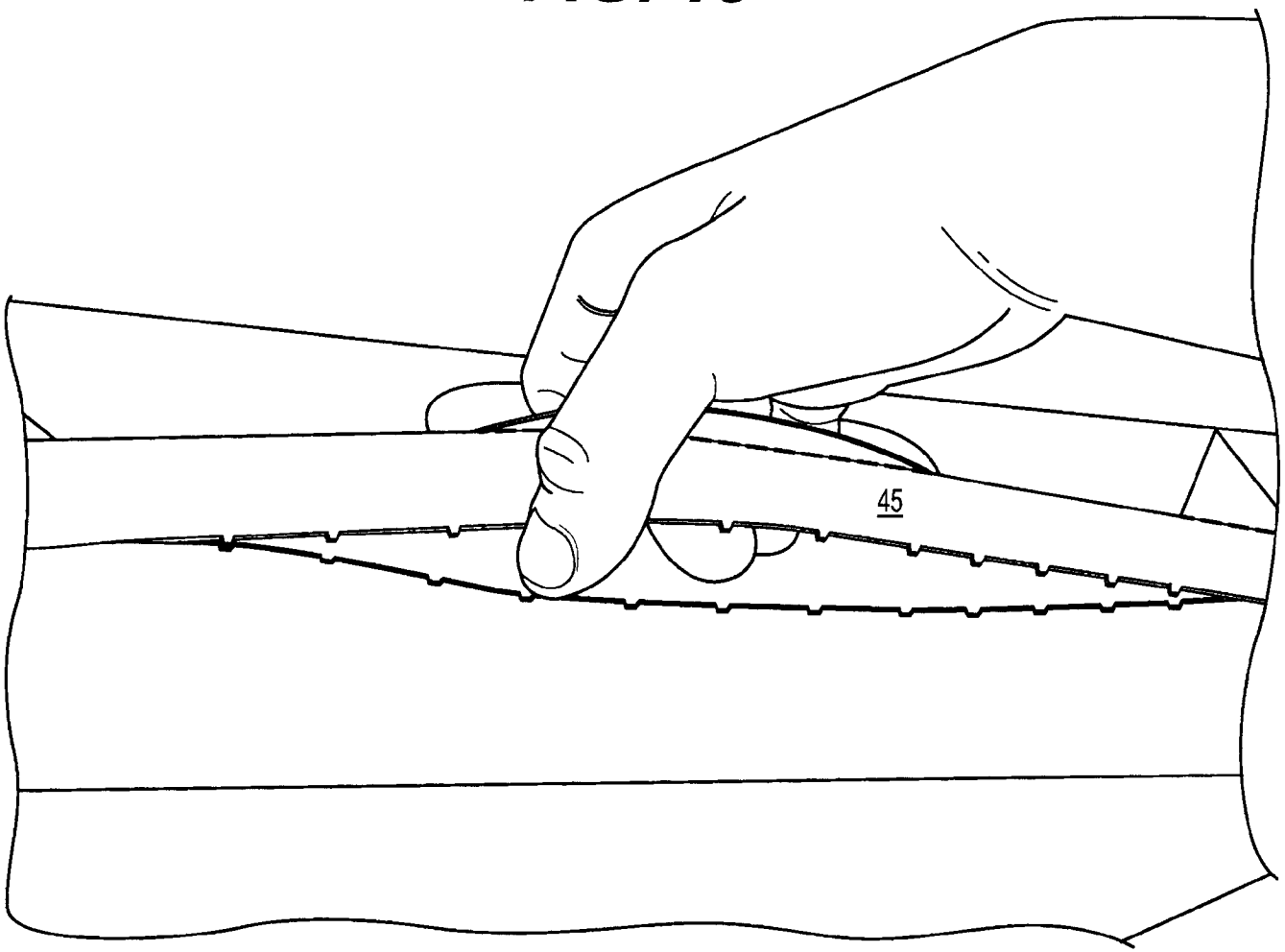
FIG. 19 shows the handle engaged to allow the package to be moved as desired.

FIG. 6 shows a large portion of the blank 10 folded along fold line 30 to dispose panels 32, 36, 40, and 48 over the panels and end flaps shown folded in FIGS. 2-4. FIG. 7 shows panel 48 folded along fold lines 42, 112, and 134 to dispose at least a portion of panel 48 over panel 24. Generally, while at least a portion of either panel 24 or panel 48 or both receive adhesive to adhere at least a portion of panel 48 to panel 24, typically only part, the sides, of the glue receiving side of perforation 44 is glued down. Then, as shown in FIGS. 17, 18, and 19 and described more fully below, perforation 44 can be activated (detaching along tear lines) to extend the handle round and allow fingers or a hand to be moved under the strap forming the extended handle.

Figure 8:
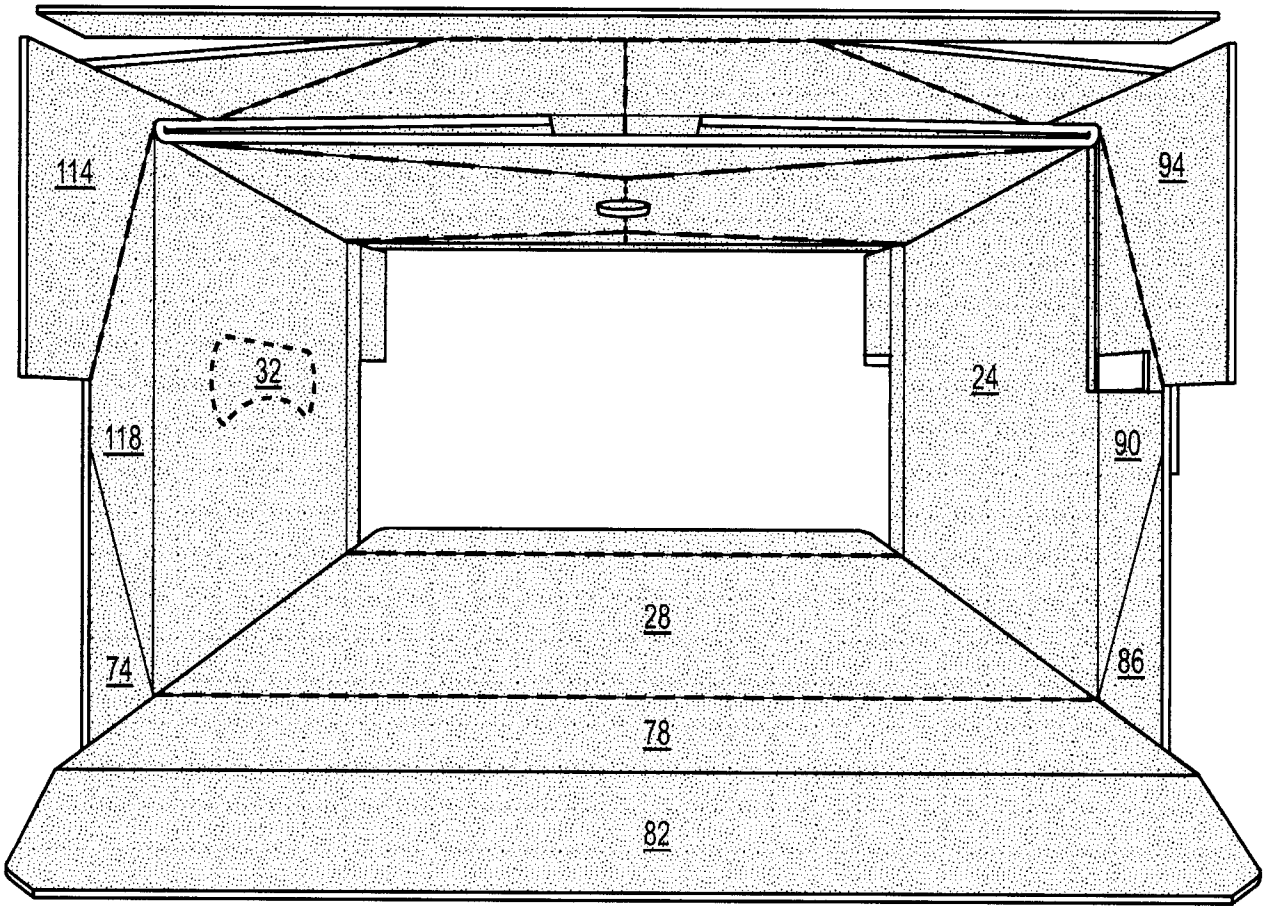

Generally, an adhesive, such as glue, is applied to adhere glue flaps or sections. FIGS. 3 and 4 show glue flap folded over, such as to multiply the handle. Adhesive can be applied along a glue line to only one of the panels to form as sleeve as shown in FIG. 8. Also shown in FIG. 8, the folding of end flaps 74 and 86, shown at lower corners of the sleeve, form a chamber with an upper edge above the bottom. This chamber assists in holding the ice or other substance once the sleeve is formed into a carton.

Figure 9:
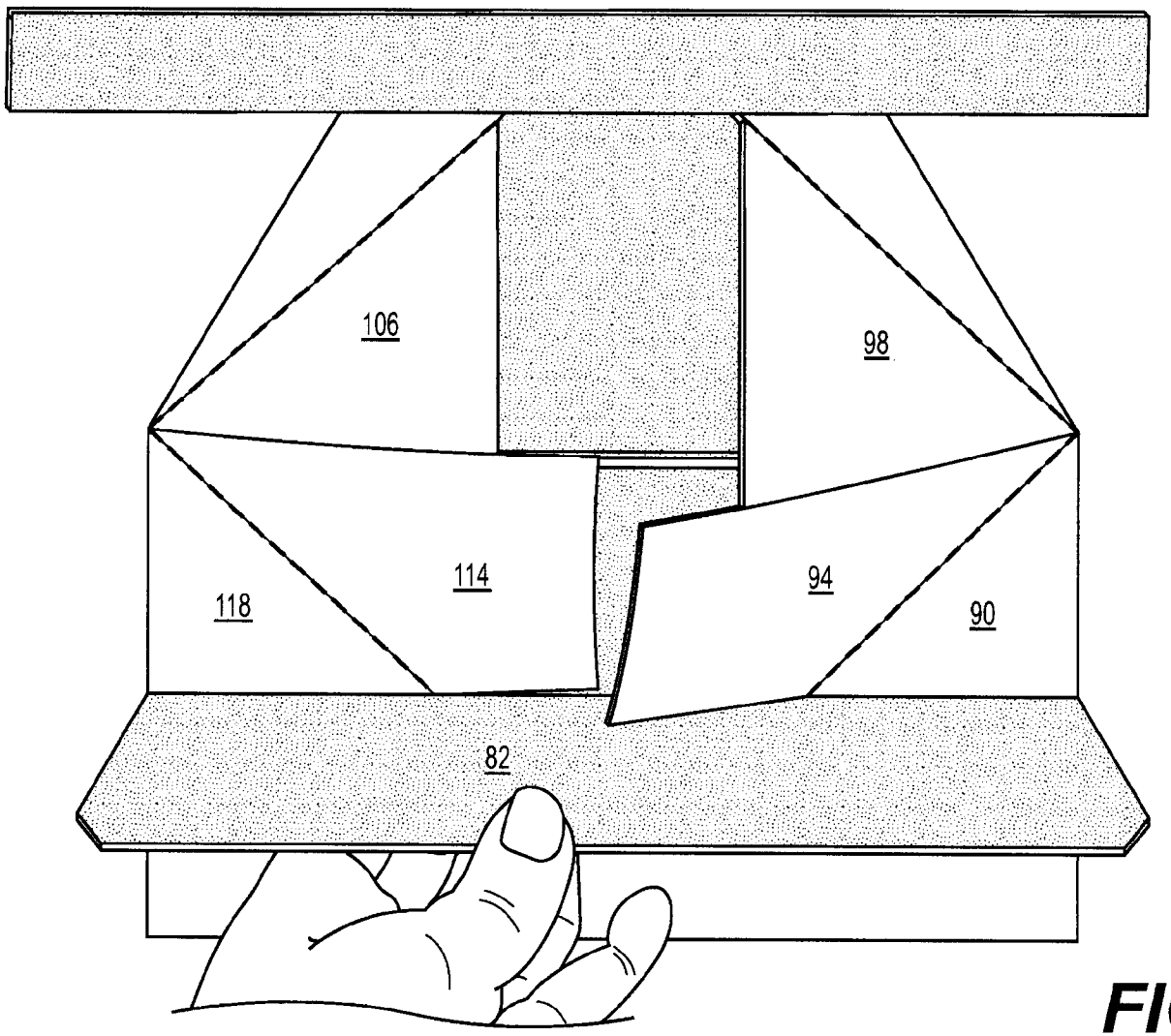
FIGS. 9-11 show the steps of folding the ends to enclose the carton.

FIG. 9 shows one end of the carton being closed, with panels 86, 90, 94, and 98 folded along fold lines 51 and 100 and panels 106, 114, 118, and 122 folded along fold lines 51 and 104. When the panels are folded along diagonal fold lines 100 and 104, portions of panels 94 and 98 are disposed over panel 102 and portions of panels 106 and 114 are disposed over panel 105. FIG. 9 also shows end flap 78 folded over portions of end flaps 86, 90, 118, and 122 and end flap 82 hinged along fold line 80 allowing panels 94 and 114 to hinge outward as desired. Generally, end flap 78 or end flaps 86, 90, 118, or 122, or a combination of any of these, will receive an adhesive, such as glue, to secure such end flaps together. The other end is closed in substantially the same manner as just described, with end flaps 124, 128, 132, and 136 folded along fold lines 11 and 138 and end flaps 144, 152, 156, and 160 folded along fold lines 11 and 142. Further, end flaps 164 are disposed over portions of end flaps 124, 128, 156, and 160. End flap 168 is foldable along fold line 166 to allow end flaps 132 and 152 to flex outwardly when desired.

Figure 10:
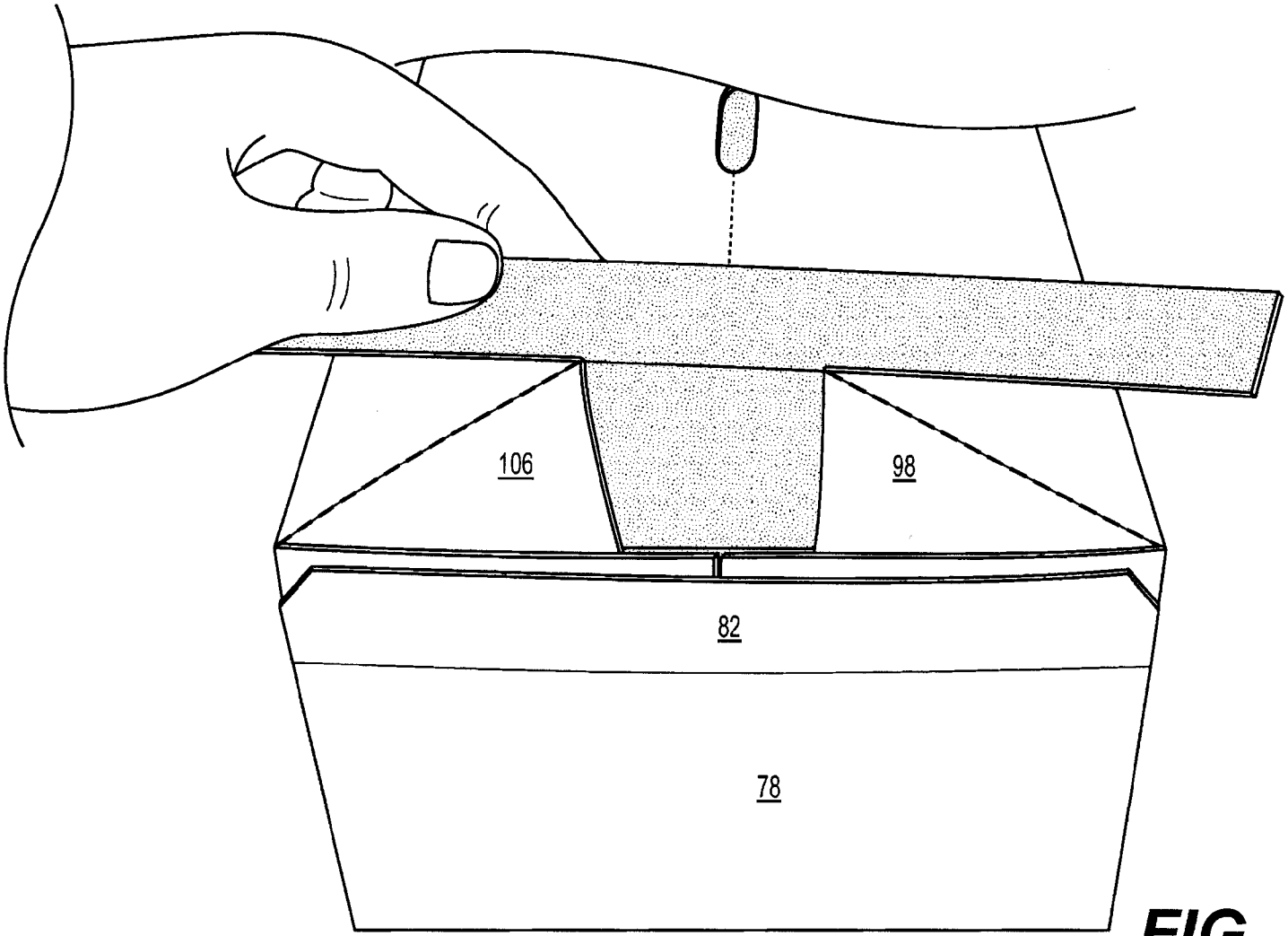

FIG. 10 shows end flap 82 adhered over at least portions of end flaps 90, 94, 114, and 118. Although not shown, at the other end of the carton, end flap 168 is disposed over and adhered to at least portions of end flaps 128, 132, 152, and 156.

Figure 11:
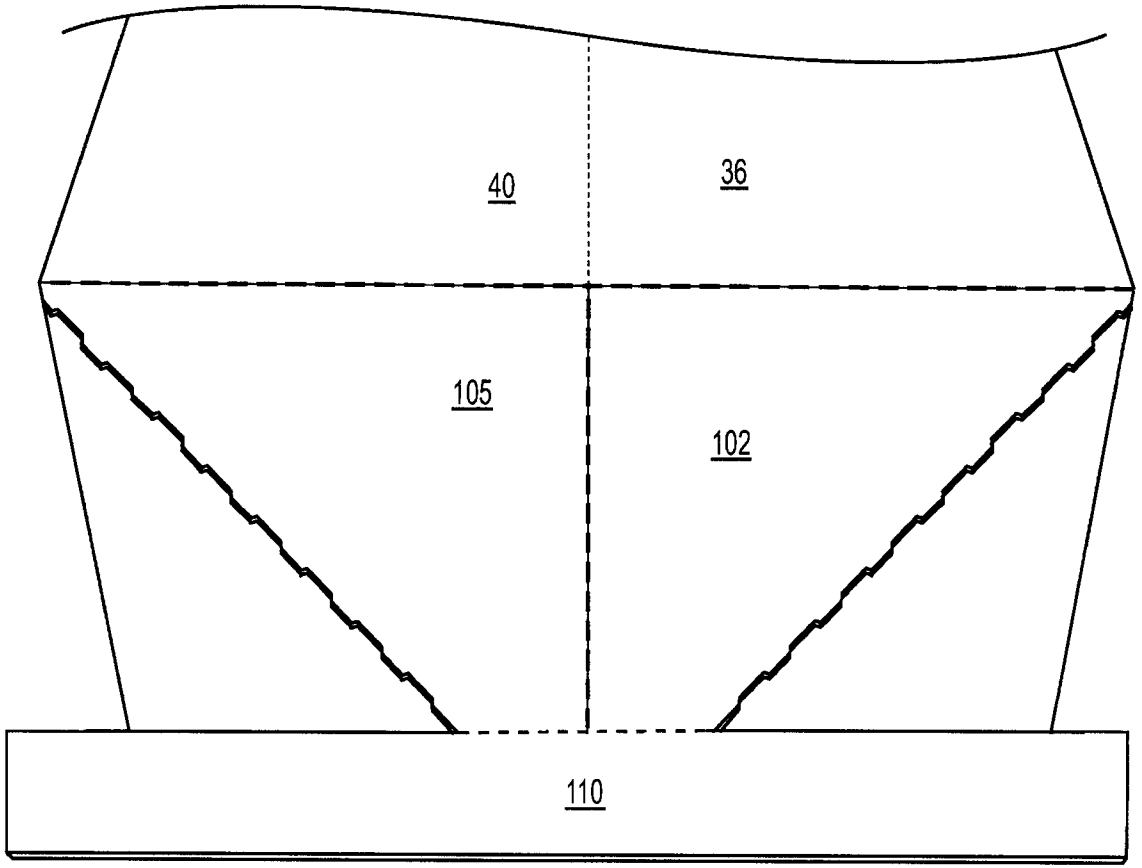
Figure 12:
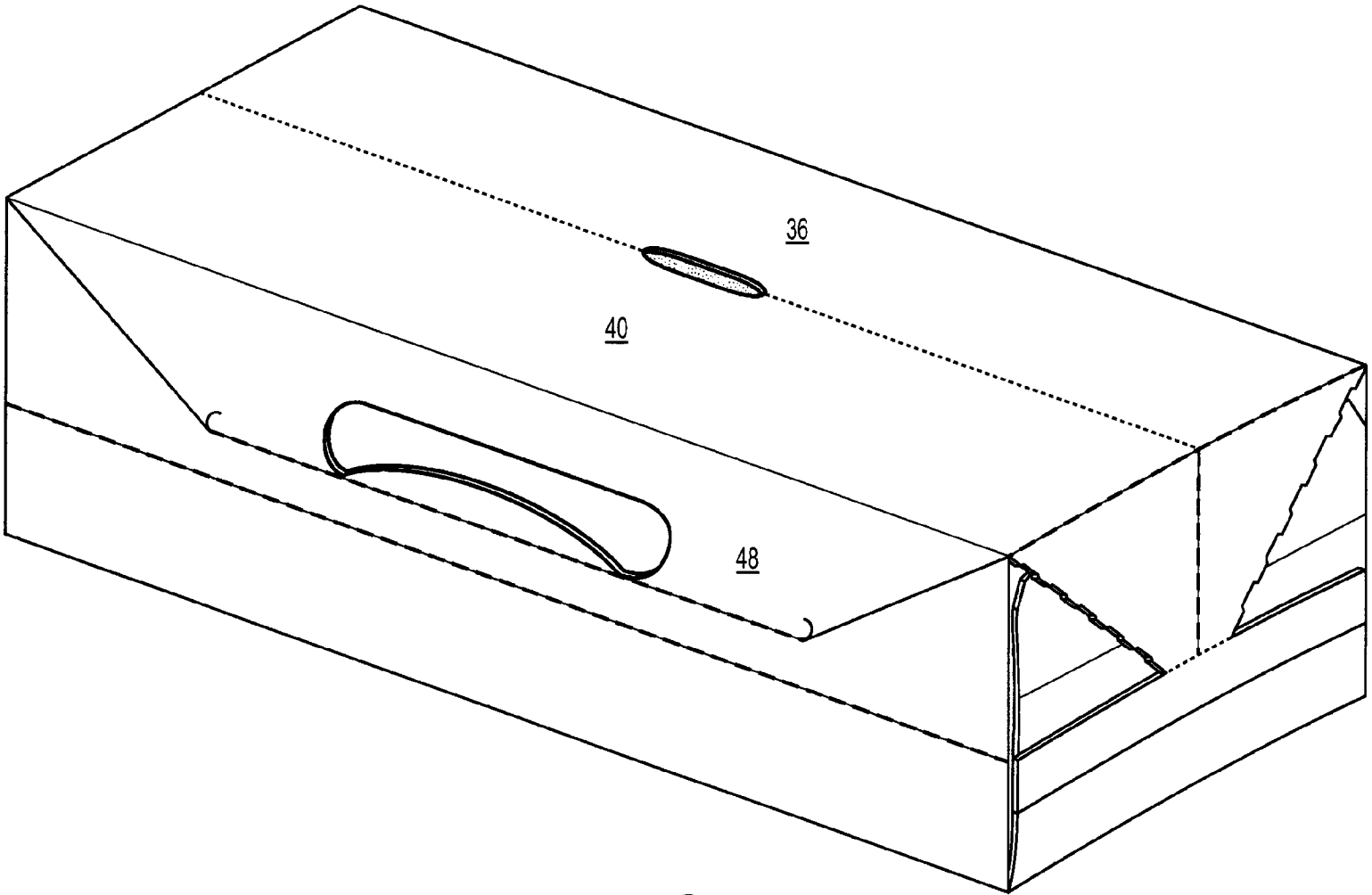
FIG. 12 shows the enclosed carton fully formed.

FIG. 11 shows end flaps 102 and 105 folded along fold line 51 to dispose end flap 110 over end flap 78 to which it is adhered. At the other end, though not shown, end flaps 140 and 141 are folded along fold line 11 to dispose panel 148 over at least a portion of panel 164 to which it is adhered. FIG. 12 shows the carton completely enclosed with both ends sealed.

Figure 13:
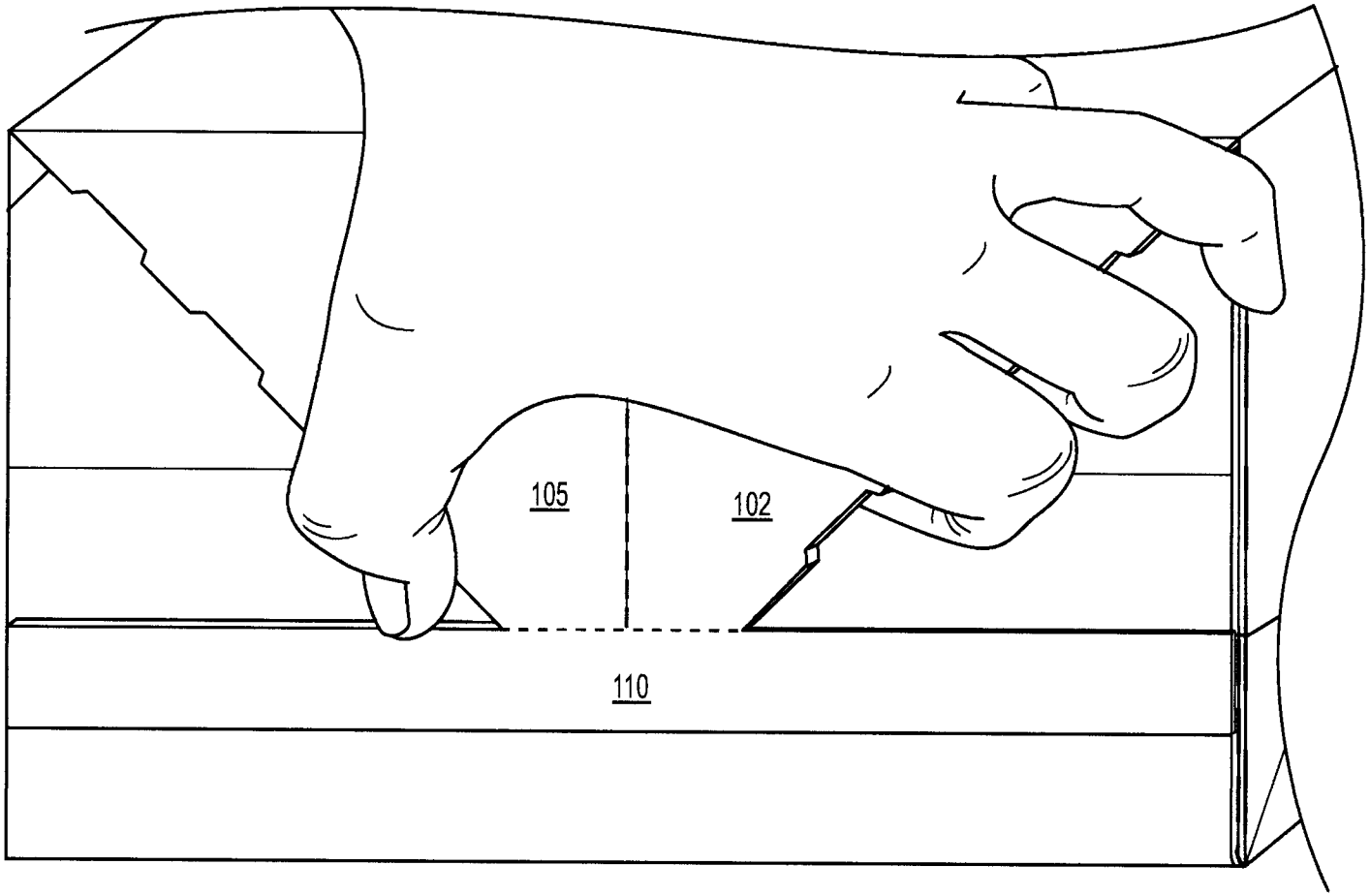
FIGS. 13 and 14 show the sides of the carton being opened.
Figure 14:
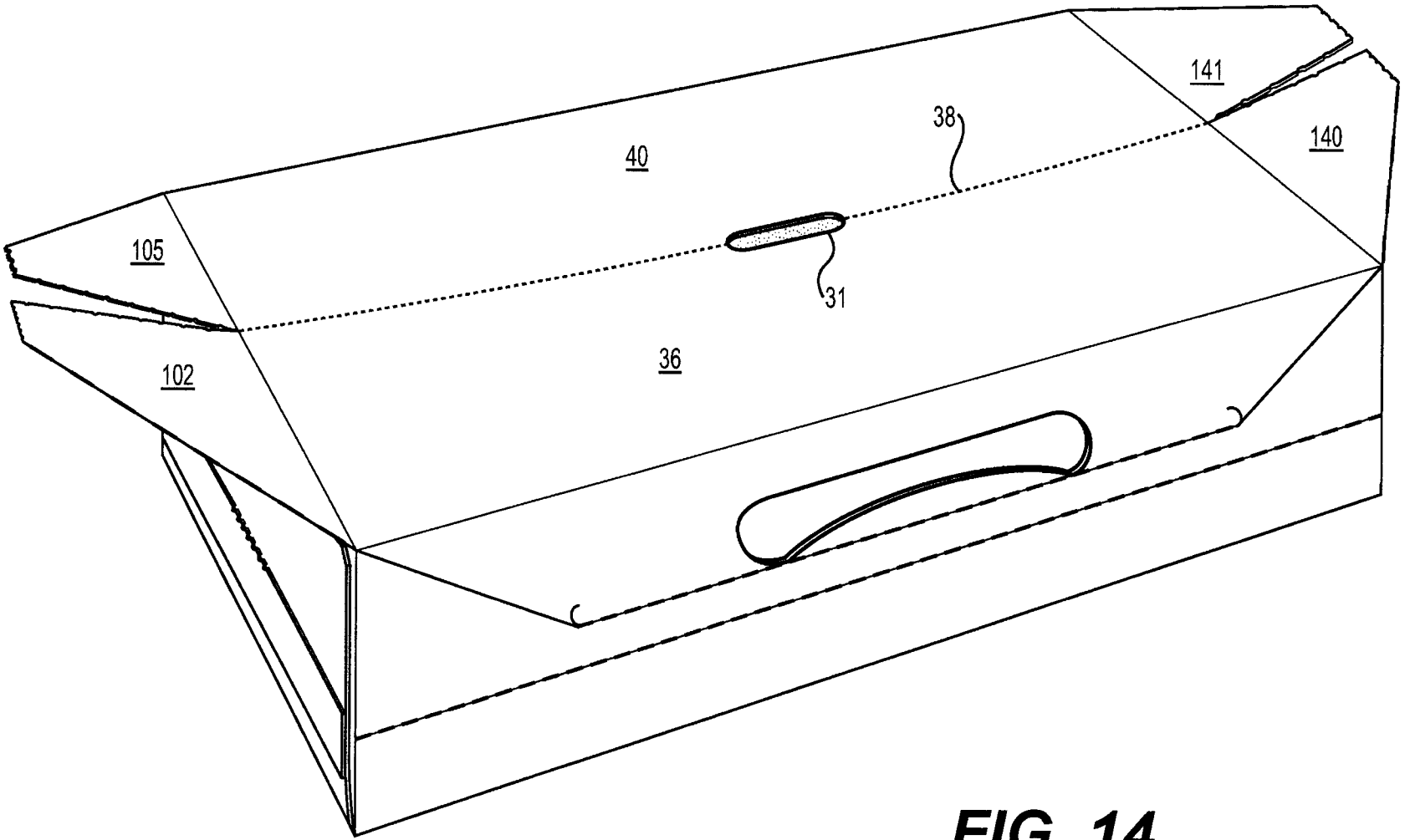

FIGS. 13-16 show the steps of opening the enclosed carton of FIG. 12, in accordance with one acceptable example. In FIG. 13 end flaps 102 and 105 are separated by tearing along separation line 109. Similarly, at the other end, end flaps 140 and 141 are separated by tearing along separation line 147. Both ends are shown entirely separated by tearing along separation lines 109 and 147 in FIG. 14. Also shown in FIG. 14, end flaps 102 and 105 are separated along tear line 103 and end flaps 140 and 141 are separated along tear line 139. As shown in both FIGS. 12 and 14, handle 45 is located isolated from the inner chamber that houses ice and containers. The handle provides additional advantages in this location, including preventing leakage therethrough.

Figure 15:
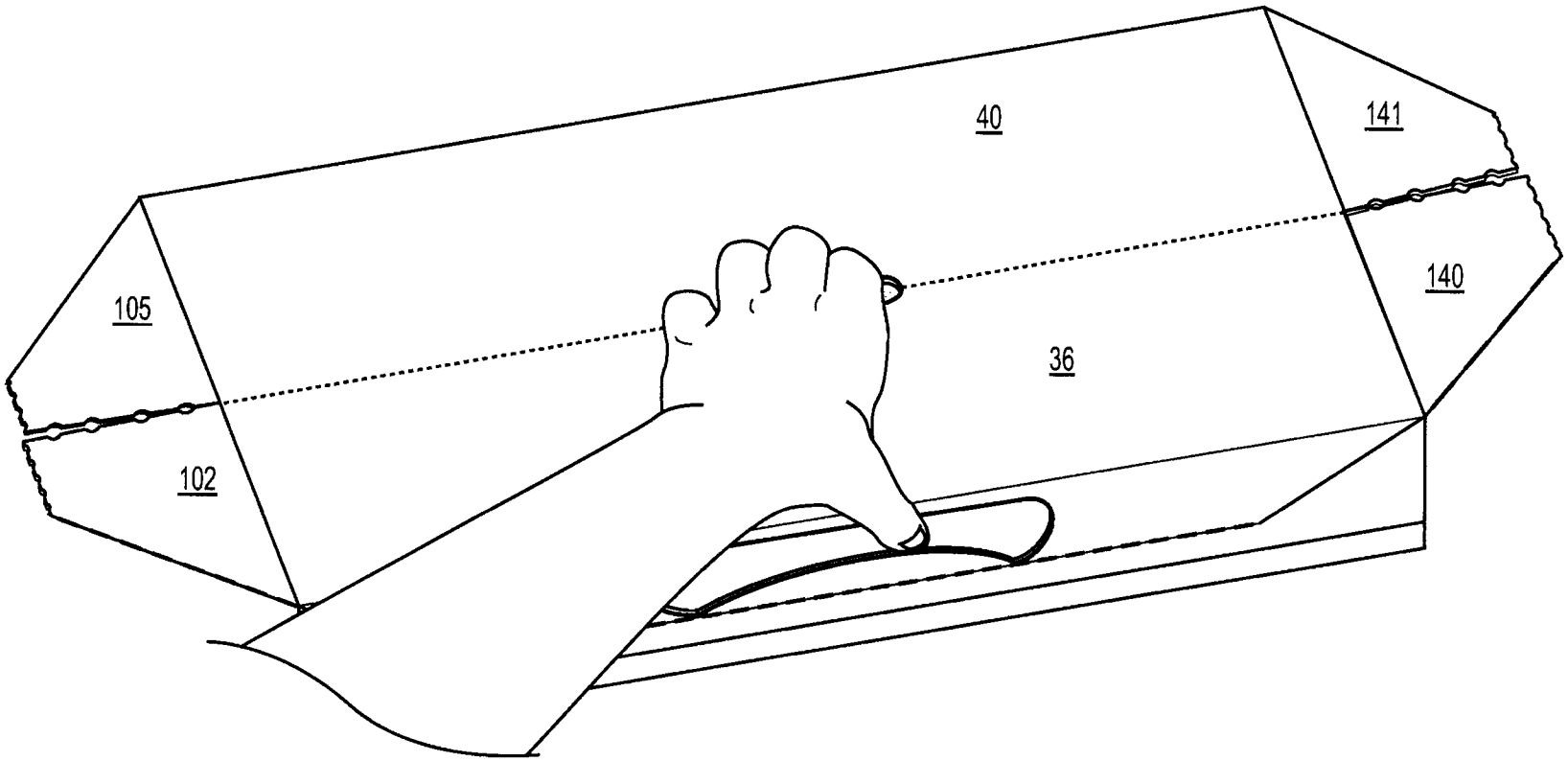
FIG. 15 shows the engagement and opening of the center portion of the top panels.
Figure 16:
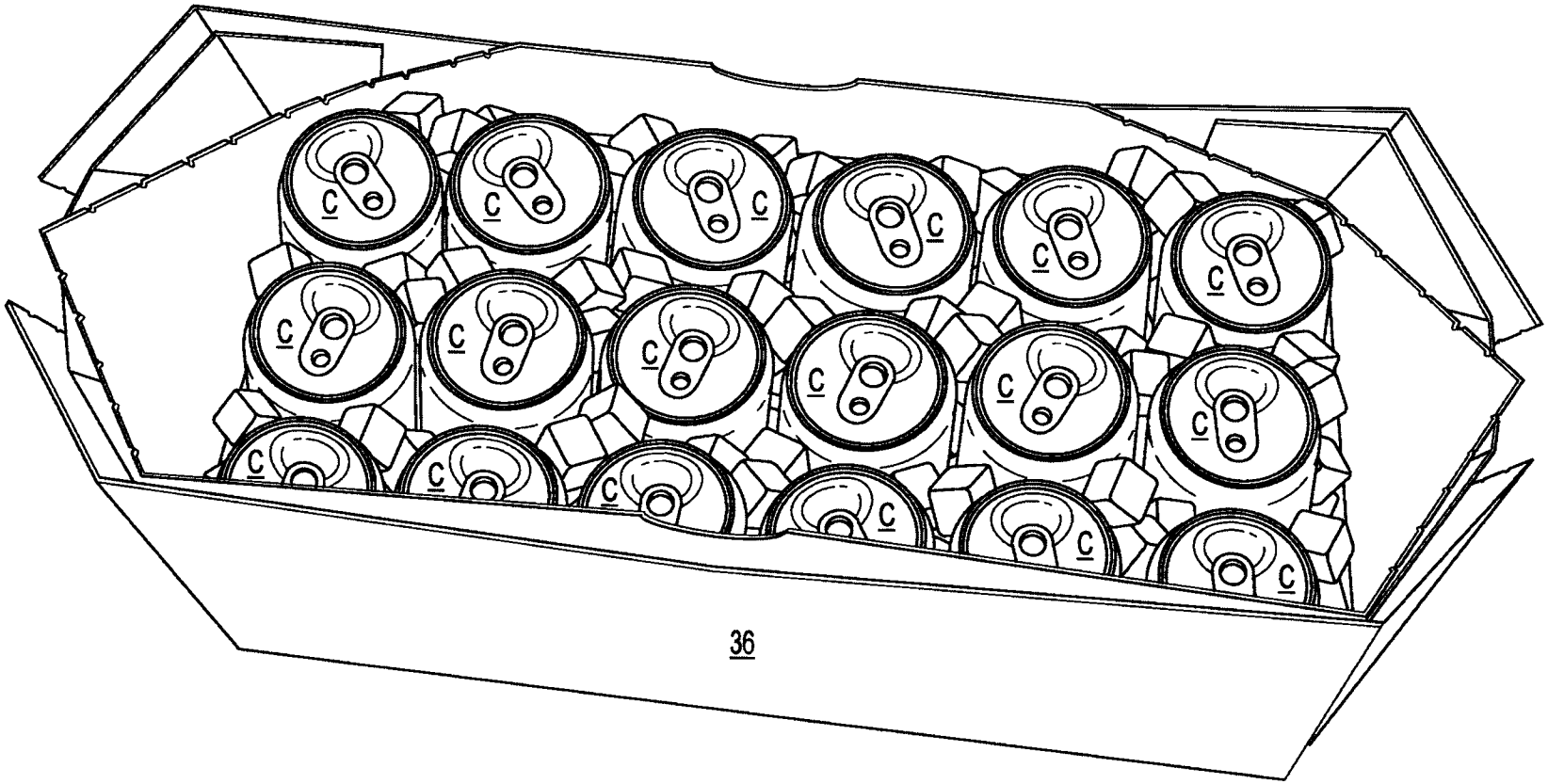
FIG. 16 shows the carton entirely open with cans disposed therein.

FIG. 15 shows a person accessing openings 21 and 31 to separate panels 36 and 40 by tearing along separation line 38 and to separate panels 16 and 20 by tearing along line of separation 18. FIG. 16 shows the carton entirely opened along the lines of separation with containers C disposed therein. The upwardly open features are shown triangular to assist keeping ice or other substance in the carton. These triangular openings also increase the opening area to receive ice above and around containers C.

The upwardly open carton shown in FIG. 16 can be infused with, or otherwise receive, ice or other substance to disposed such ice around the containers C, over the containers C, or both (e.g., ice can be introduced through the upper opening). Thus, the carton can act as a cooler or the like. Further, if desired at any time, the carton can be rehinged along the fold lines to enclose all or part of the containers or ice or both within the carton. The upper opening is generally sized to receive ice or other cooling or heating implement. The upper opening can include numerous flaps and panels that can be disposed in a number of orientations unique to embodiments of the present invention.

Since generally only the sides of handle 45 adjacent the end flaps receive glue, the handle 45 can be separated along tear lines 44 and 46 as shown in FIGS. 18 and 19. To activate handle 45, finger(s) or other object can be inserted into handle opening 41 as shown in FIG. 17. The configuration of the carton formed from blank 10 allows receipt of the fingers or other object since handle opening 41 is separated from panel 24 to form a receiving space therebetween. Handle 45 is then separated from the carton along tear lines 44 and 46 as shown in FIG. 18. Handle 45 can then be used to move the package as desired as shown in FIG. 19.

The blank and thus resulting carton can be modified to enhance certain panel or end flap features, to accommodate larger or smaller containers or articles within the package, or to enhance strength overall or in certain areas. For example, panel 12 can be increased in width with a fold line being added at a peripheral portion thereof, this fold line can be disposed parallel to fold line 14. Also, the ends of panel 12 can be formed to extend diagonally away from end flaps 60 and 186, respectively. Further, end flaps 110 and 148 can be increased in width. Although these modifications are not shown in the figures, they are considered part of the present invention.

In accordance with the exemplary embodiments of the present invention, the blanks can be formed from paperboard, corrugated cardboard or other materials having properties suitable for at least generally enabling the respective functionalities described above. Paperboard is typically of a caliper such that it is heavier and more rigid than ordinary paper, and corrugated cardboard is typically of a caliper such that it is heavier and more rigid than paperboard. Typically, at least the side of the paperboard or cardboard that will be an exterior surface in the carton erected therefrom will be coated with a clay coating, or the like. The clay coating can be printed over with product, advertising, price-coding, and other information or images. The blanks may then be coated with a varnish to protect any information printed on the blanks. The blanks may also be coated with, for example, a moisture barrier layer, on one or both sides. The blanks can also be laminated to or coated with one or more sheet-like materials.

In accordance with the exemplary embodiments of the present invention, a fold line can be any at least somewhat line-like arranged, although not necessarily straight, form of weakening that facilitates folding therealong; and a tear line can be any at least somewhat line-like arranged, although not necessarily straight, form of weakening that facilitates tearing therealong. More specifically, but not for the purpose of narrowing the scope of the present invention, conventional fold lines include: a crease, such as formed by folding; a score line, such as formed with a blunt scoring knife, or the like, which creates a crushed portion in the material along the desired line of weakness; a slit that extends partially into the material along the desired line of weakness, and/or a series of spaced apart slits that extend partially into and/or completely through the material along the desired line of weakness; or various combinations of these features. More specifically, but not for the purpose of narrowing the scope of the present invention, conventional tear lines include: a slit that extends partially into the material along the desired line of weakness, and/or a series of spaced apart slits that extend partially into and/or completely through the material along the desired line of weakness, or various combinations of these features.

As a more specific example, one type of conventional tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like.

The invention has been described in terms of preferred configurations and methodologies considered by the inventors to be the best mode of carrying out the invention. These preferred embodiments are presented as examples only and should not be construed as limiting the scope of the invention. A wide variety of additions, deletions, and modifications to the illustrated and described embodiments might be made by those of skill in the art without departing from the spirit and scope of the invention.

What is claimed is:

1. A carton for cooling containers, the carton comprising:

a first top panel, a second top panel, a first side panel, a second side panel, a bottom panel, and two ends formed by at least one end flap;

the first top panel being separable along a first tear line and the second top panel being separable along a second tear line;

a first access opening separating the first tear line into at least two segments and a second access opening separating the second tear line into at least two segments; and, the first top panel being disposed over the second top panel so that the first tear line is in registration with the second tear line and so that the first access opening is aligned with the second access opening.

2. The carton of claim 1 wherein the first top panel and the second top panel can be separated into their two sections to expose at least partially containers in the carton.

3. The carton of claim 1 wherein the first tear line and the second tear line are parallel.

4. The carton of claim 1 wherein the first tear line lies over the second tear line.

5. The carton of claim 1 wherein the first access opening is covered by a first finger flap.

6. The carton of claim 1 wherein the second access opening is covered by a second finger flap.

7. The carton of claim 1 wherein the first access opening and the second access opening form a single access opening.

8. The carton of claim 1 wherein after the first top panel and the second top panel are opened along the first tear line and the second tear line, respectively, a cooling substance is provided in the carton.

9. The carton of claim 1 wherein the first tear line and the second tear line extend at least partially into the two ends.

10. The carton of claim 1 wherein the two ends are formed with more than one layer of paperboard.

11. A blank capable of being formed in a carton sized to contain a plurality of containers, the blank comprising:

a first top panel with a first tear line for separating the first top panel into at least two first sections;

the first top panel connected to a first side panel along a first fold line;

the first side panel connected to a bottom panel along a second fold line;

the bottom panel connected to a second side panel along a third fold line;

the second side panel connected to a second top panel along a fourth fold line;

the second top panel including a second tear line for separating the second top panel into at least two second sections;

the second top panel connected to a connecting panel along a fifth fold line;

a first access opening in the first top panel and a second access opening in the second top panel; and, a first transverse fold, line and a second transverse fold line disposed perpendicular the first, second, third, fourth, and fifth fold lines; the first transverse fold line and the second transverse fold line at least partially defining end flaps along edge portions of the first top panel, first side panel, bottom panel, second side panel, and second top panel;

wherein the first tear line is for being in registration with the second tear line and the first access opening is for being aligned with the second access opening when forming a carton from the blank.

12. The blank of claim 11 wherein the first access opening is disposed along the first tear line.

13. The blank of claim 12 wherein the first access opening is covered by a first finger flap.

14. The blank of claim 11 wherein the second access opening is disposed along the second tear line.

15. The blank of claim 14 wherein the second access opening is covered by a second finger flap.

16. The blank of claim 11 wherein the at least two first sections are each approximately half the first top panel.

17. The blank of claim 11 wherein the at least two second sections are each approximately half the second top panel.

18. The blank of claim 11 wherein the connecting panel includes a handle.

19. The blank of claim 11 wherein the end flaps of the second top panel include a first end flap adjacent the first transverse fold line and a second end flap adjacent the second transverse fold line; the second tear line extending into the first end flap and the second end flap.

20. The blank of claim 19 including a third tear line in the first end flap and a fourth tear line in the second end flap; the third tear line and the fourth tear line generally parallel the first and second transverse fold lines.

* * * * *